US006675877B2

(12) United States Patent
Sandu et al.

(10) Patent No.: US 6,675,877 B2
(45) Date of Patent: Jan. 13, 2004

(54) SEAL-LESS MAGNETICALLY DRIVEN SCRAPED-SURFACE HEAT EXCHANGER

(75) Inventors: Constantine Sandu, Tustin, CA (US); Liviu V. Popa, Garden Grove, CA (US); John J. Mercurio, Rossford, OH (US)

(73) Assignee: Conagra Grocery Products Company, Irvine, CA (US)

( * ) Notice: Subject to any disclaimer, the term of this patent is extended or adjusted under 35 U.S.C. 154(b) by 0 days.

(21) Appl. No.: 10/231,588

(22) Filed: Aug. 29, 2002

(65) Prior Publication Data

US 2003/0042007 A1 Mar. 6, 2003

Related U.S. Application Data

(60) Provisional application No. 60/316,103, filed on Aug. 29, 2001, and provisional application No. 60/324,309, filed on Sep. 24, 2001.

(51) Int. Cl.[7] ..... F28F 5/00; A23L 1/25

(52) U.S. Cl. ..... 165/91; 165/94; 366/273

(58) Field of Search ..... 165/86, 89, 90, 165/92, 94, 91; 366/273, 274

(56) References Cited

U.S. PATENT DOCUMENTS

| | | | |
|---|---|---|---|
| 261,234 | A | 7/1882 | Jameson |
| 1,233,569 | A | 7/1917 | Graemiger |
| 1,847,006 | A | 2/1932 | Kalischer |
| 2,206,006 | A | 6/1940 | Hendrey |
| 2,514,116 | A | 7/1950 | Baker |
| 3,063,041 | A | 11/1962 | Quade et al. |
| 3,839,085 | A | 10/1974 | Hulvey et al. |
| 4,279,295 | A | 7/1981 | Duckworth |
| 5,485,880 | A | 1/1996 | Zeuthen |
| 5,593,378 | A | 1/1997 | Dyck |
| 5,645,355 | A | 7/1997 | Tokushima et al. |
| 5,755,106 | A | 5/1998 | Ross |
| 6,220,047 | B1 | 4/2001 | Vogel et al. |
| 6,438,987 | B1 | 8/2002 | Pahl |
| 6,467,944 | B2 | 10/2002 | Ugolini |

FOREIGN PATENT DOCUMENTS

| | | |
|---|---|---|
| JP | 353025062 A | 3/1978 |
| RU | 247071 | 4/1969 |

*Primary Examiner*—Allen Flanigan
(74) *Attorney, Agent, or Firm*—Bingham McCutchen LLP

(57) ABSTRACT

A seal-less magnetically driven scraped-surface heat exchanger is provided that is particularly useful for aseptic processing. The heat exchanger comprises an elongated generally cylindrical heat transfer tube having an inlet, an outlet, and a sidewall defining a chamber between the inlet and the outlet. An elongated media tube is provided in surrounding relation to the heat transfer tube. A rotary shaft is mounted axially within the heat transfer tube. The rotary shaft has an outer surface and one or more scraper blades extending from the outer surface of the rotary shaft. A drive end containment shroud is mounted at an axial end of the heat transfer tube. The drive end containment shroud has a closed end, an open end, and a sidewall defining a drive chamber in open communication with the interior chamber of the heat transfer tube through the open end of the containment shroud. An inner rotatable magnet assembly is mounted within the drive chamber of the drive end containment shroud and connected to the rotary drive shaft. An outer rotatable magnet assembly is mounted outside the drive end containment shroud and magnetically coupled to the inner rotatable magnet assembly. In use, rotation of the outer magnet assembly results in rotation of the inner magnet assembly, which results in rotation of the rotary drive shaft.

30 Claims, 10 Drawing Sheets

SEAL-LESS MAGNETICALLY DRIVEN SCRAPED-SURFACE HEAT EXCHANGER

CROSS-REFERENCE TO RELATED APPLICATION(S)

This application claims priority to U.S. Provisional Patent Application No. 60/316,103, filed Aug. 29, 2001, and 60/324,309, filed Sep. 24, 2001, the entire disclosures of which are incorporated herein by reference.

FIELD OF THE INVENTION

The present invention is generally directed to devices used in industrial septic processing and, more specifically, to a mechanically seal-less magnetically driven scraped-surface heat exchanger.

BACKGROUND

Scraped-surface heat exchangers are commonly utilized in aseptic processing of foodstuffs. These heat exchangers are preferred because of their capability to process heat-sensitive, viscous, or particulate-laden products, enhance the heat transfer of viscous products, and minimize the extent of burn-on, or fouling on the heat transfer surface. Such heat exchangers are commonly marketed under the trade names, for example, Votator®, Thermutator®, Contherm® and Terlotherm®. Waukesha Cherry-Burrell, Delavan, Wis., for example, manufactures such heat exchangers.

FIG. 1 illustrates the basic operating principles of a scraped surface heat exchanger. In particular, a scraped surface heat exchanger 12 generally consists of mutator shaft 13 that rotates within a heat transfer tube 14. Foodstuff passes though through an annulus 15 formed between the shaft and the heat transfer tube. A heating or cooling medium generally flows through a jacket 16 formed about the heat transfer tube, while insulation 17 surrounds the jacket to minimize energy heat loss. Generally a stainless steel cover 18 protects the insulation and forms the outer housing. In operation, the rotating shaft carries a series of staggered blades 19 that continuously scrape product film from the heat transfer tube wall. The "cleaned" wall thus, enhances heat transfer, and produces a homogenous of foodstuff passing through the heat exchanger.

It is desirable for the entire rotating shaft assembly to be able to be easily removed for inspection and maintenance. Typically a scraped-surface heat exchanger is designed with two boltless V-lock heads, one at each end of the heat exchangers. The boltless V-lock at the opposite drive head end contains a frictionless ball-bearing to support the rotating shaft and a rotary mechanical seal in direct contact with the product inside the heat exchanger. In contrast, the boltless V-lock at the drive head end encompasses the second rotary mechanical seal only. The corresponding second frictionless ball-bearing to support the rotating shaft is located inside the gear box of the mechanical drive.

A typical rotary (or dynamic) mechanical seal for a scraped-surface heat exchanger includes a seal head insert and a seal body insert, both contributing to the mechanical seal face. Standard seal faces consist of hardened surfaces like silicon carbide or chromium oxide against a special graphite compound. In aseptic processing, these mechanical seal faces serve both to maintain a mechanical seal (i.e., a pressure differential between the inside and outside of the heat exchanger) and an aseptic seal (i.e., an aseptic-safety barrier between the inside and outside of the heat exchanger). To ensure seal integrity, a mechanical seal face needs to be properly lubricated, kept free of foreign material, and maintained at a low temperature. For these reasons, a barrier fluid has to continuously flood the rotary mechanical seal. In aseptic processing, this barrier fluid must meet high purity and safety standards.

Nonetheless, the possibility that one of the mechanical parts of the two rotary mechanical seals of a traditional scraped-surface heat exchanger fails during operation is very high. Notably, under the operating conditions associated with aseptic processing, a mechanical failure of the rotary mechanical seal (which generally causes product leakage) can result in an aseptic failure. Thus, a need exists for a seal-less scraped-surface heat exchanger that is compatible with the requirement-s of aseptic processing of food products, such as puddings and gels.

SUMMARY OF THE INVENTION

The present invention is directed to a seal-less magnetically driven scraped-surface heat exchanger that is particularly useful for aseptic processing. By eliminating the mechanical seals used in traditional heat exchangers (with their numerous associated parts), the present invention reduces the possibility of mechanical failure at the ends of the heat exchanger.

In one embodiment, the invention is directed to a scraped-surface heat exchanger comprising an elongated generally cylindrical heat transfer tube having an inlet, an outlet, and a sidewall defining a chamber between the inlet and the outlet. An elongated media tube is provided in surrounding relation to the heat transfer tube. A rotary shaft is mounted axially within the heat transfer tube. The rotary shaft has an outer surface and one or more scraper blades extending from the outer surface of the rotary shaft. A drive end containment shroud is mounted at an axial end of the heat transfer tube. The drive end containment shroud has a closed end, an open end, and a sidewall defining a drive chamber in open communication with the interior chamber of the heat transfer tube through the open end of the containment shroud. An inner rotatable magnet assembly is mounted within the drive chamber of the drive end containment shroud and connected to the rotary drive shaft. An outer rotatable magnet assembly is mounted outside the drive end containment shroud and magnetically coupled to the inner rotatable magnet assembly. In use, rotation of the outer magnet assembly results in rotation of the inner magnet assembly, which results in rotation of the rotary drive shaft.

In a particularly preferred embodiment, the heat exchanger further comprises a second containment shroud mounted at an axial end of the heat transfer tube opposite the drive head end containment shroud. The second containment shroud has a closed end, an open end, and a sidewall defining a cavity in open communication with the interior chamber of the heat transfer tube through the open end of the second containment shroud. An axial magnetic bearing system is provided comprising an axial magnetic rotor coupled to the rotary shaft and contained within the second containment shroud, and an axial magnetic bearing stator mounted outside the second containment shroud. In use, the axial magnetic bearing stator generates an electromagnetic field to longitudinally align the axial magnetic rotor and rotary shaft in a desired position relative to the heat transfer tube. A radial magnetic bearing system is also provided comprising a radial magnetic rotor coupled to the rotary shaft and contained within the second containment shroud, and a radial magnetic bearing stator mounted outside the second containment shroud. In use, the radial magnetic bearing stator generates an electromagnetic field to radially align the radial magnetic rotor and rotary shaft in a desired position relative to the heat transfer tube.

BRIEF DESCRIPTION OF THE DRAWINGS

These and other features and advantages of the present invention will be understood by reference to the following detailed descriptions when considered in conjunction with the accompanying drawings wherein.

DETAILED DESCRIPTION

Figure 1:
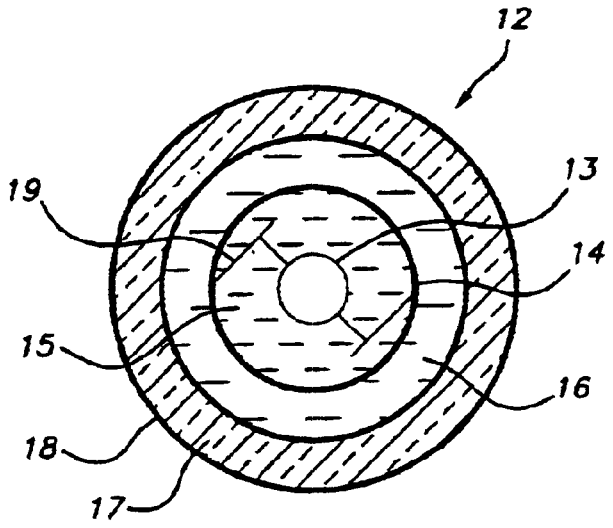
FIG. 1 (PRIOR ART)
FIG. 1 is a cross-sectional schematic of a prior art scraped surface heat exchanger.
Figure 2:
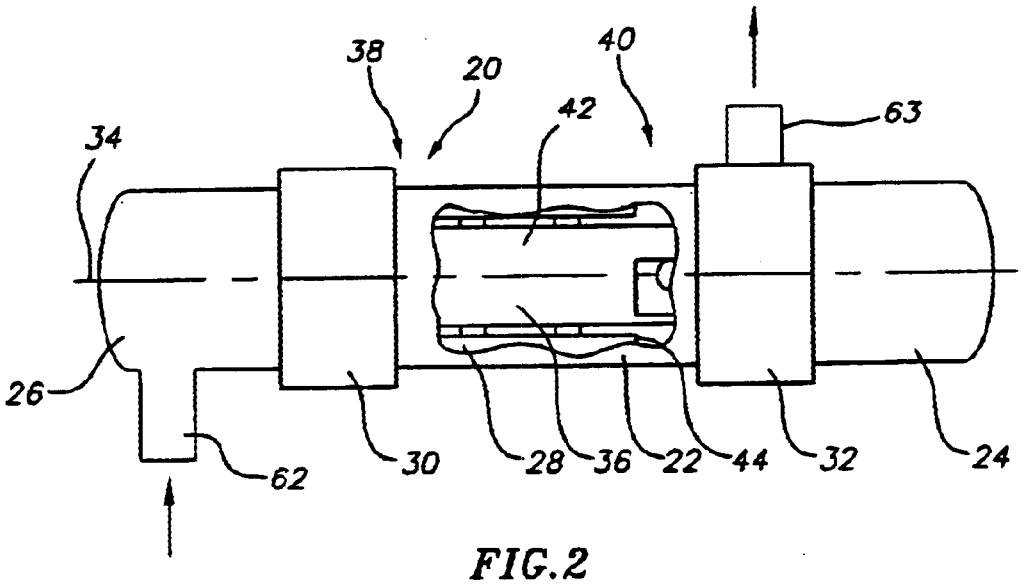
FIG. 2 is a side schematic partial cut-away view of a first embodiment heat exchanger in accordance with the invention.

The present invention is directed to a seal-less magnetic scraped-surface heat exchanger. As shown in FIG. 2, a first embodiment of the heat exchanger 20 according to the invention comprises a generally elongated cylindrical enclosure consisting of a heat transfer tube 22, a drive head end 24, an opposite drive head end 26, and hollowed interior 28. The drive head end is coupled to a first axial end of the heat transfer tube, while the opposite drive head end is coupled to an opposite axial end of the heat transfer tube. The hollowed interior 28 is symmetrically defined about a central axis 34. The hollowed interior 28 passes food product from an inlet port 62, coupled to the opposite drive head end 26, to an outlet port 63, coupled to the second support bearing member 32.

A mutator or rotary shaft 36 is rotatably mounted within the hollowed interior 28 along the central axis 34. The rotary shaft 36 is a generally elongated structure comprising a bearing end 38, a drive end 40, and a central body 42. The rotary shaft is preferably made from a corrosion resistant material, such as stainless steel. The central body 42 of the rotary shaft extends longitudinally within the hollowed interior 28 from the bearing end 38, proximate the opposite drive head end, to the drive end 40, proximate the drive head end. The central body is tapered at the bearing and drive ends 38 and 40 to diametrically reduced shaft portions received by linear bearings of the first and second bearing supports 30 and 32, respectively. The rotary shaft 36 carries a series scraper blades 44 staggered along the central body 42. The blades are supported by holding pins 46 coupled about central body. The scraper blades 44 extend from the outer surface of the central body of the rotary shaft to "scrape off" or remove any fouling deposit accumulated along the interior surface of the heat transfer tube.

In accordance with the present embodiment, the efficient operation of the heat exchanger depends on the radial and axial stiffness of the rotary shaft 36. As such, the magnetically operable drive head end 24 and the opposite drive head end 26 serve as the main bearing support for the rotary shaft 36.

Figure 3:
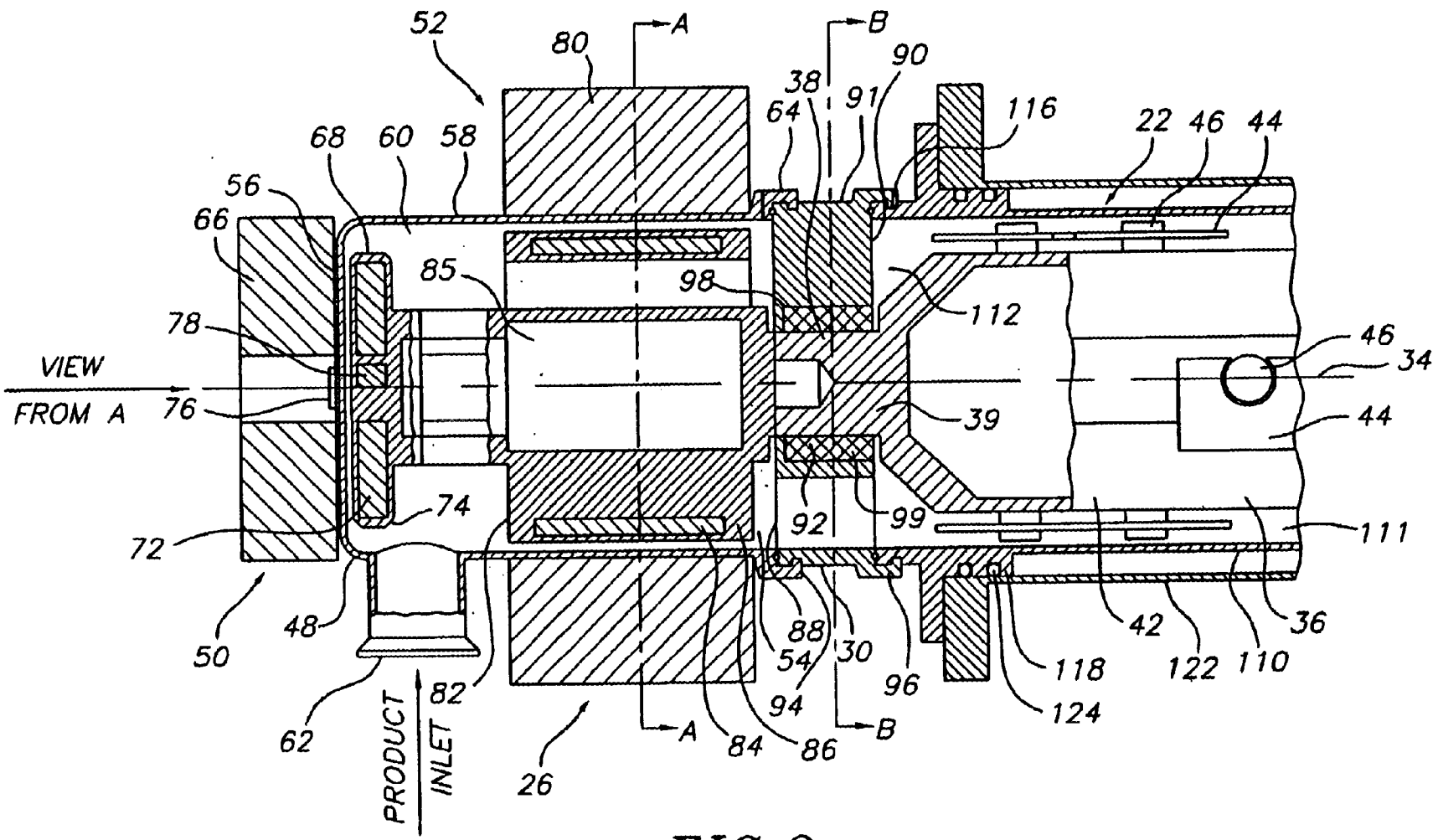
FIG. 3 is a side cross-sectional view of the opposite drive end head of the heat exchanger of FIG. 2.

Starting at the opposite drive head, as shown in FIG. 3, the opposite drive head end 26 comprises a first containment shroud 48, an axial magnetic bearing system 50, and a radial magnetic bearing system 52. The containment shroud is a generally cylindrical structure comprising an open end 54, a closed end 56, and an annular first containment shroud sidewall 58 axially extending between the open and closed ends. The containment shroud may be made from stainless steel or any suitable corrosion resistant material. The first containment shroud sidewall 58 is symmetrically disposed about the heat exchanger's central axis 34. The first containment shroud sidewall 58 and the closed end 56 define a cavity 60 for receiving a rotor coupled to the bearing end 38 of the rotary shaft 36, as discussed further below.

An inlet port 62 outwardly extending from the first containment shroud sidewall 58 near the closed end 56 passes food product entering the heat exchanger to the cavity 60. A first bearing support member 30 couples the opposite drive head end 26 the first containment shroud. A first substantially V-shaped locking member 64 is integrally formed about the open end 54 of the first containment shroud 48. The locking member is configured to engage an annular locking groove formed about a corresponding axial end of the first bearing support 30 to couple the first containment shroud 48 to the heat transfer tube 22.

Figure 4:
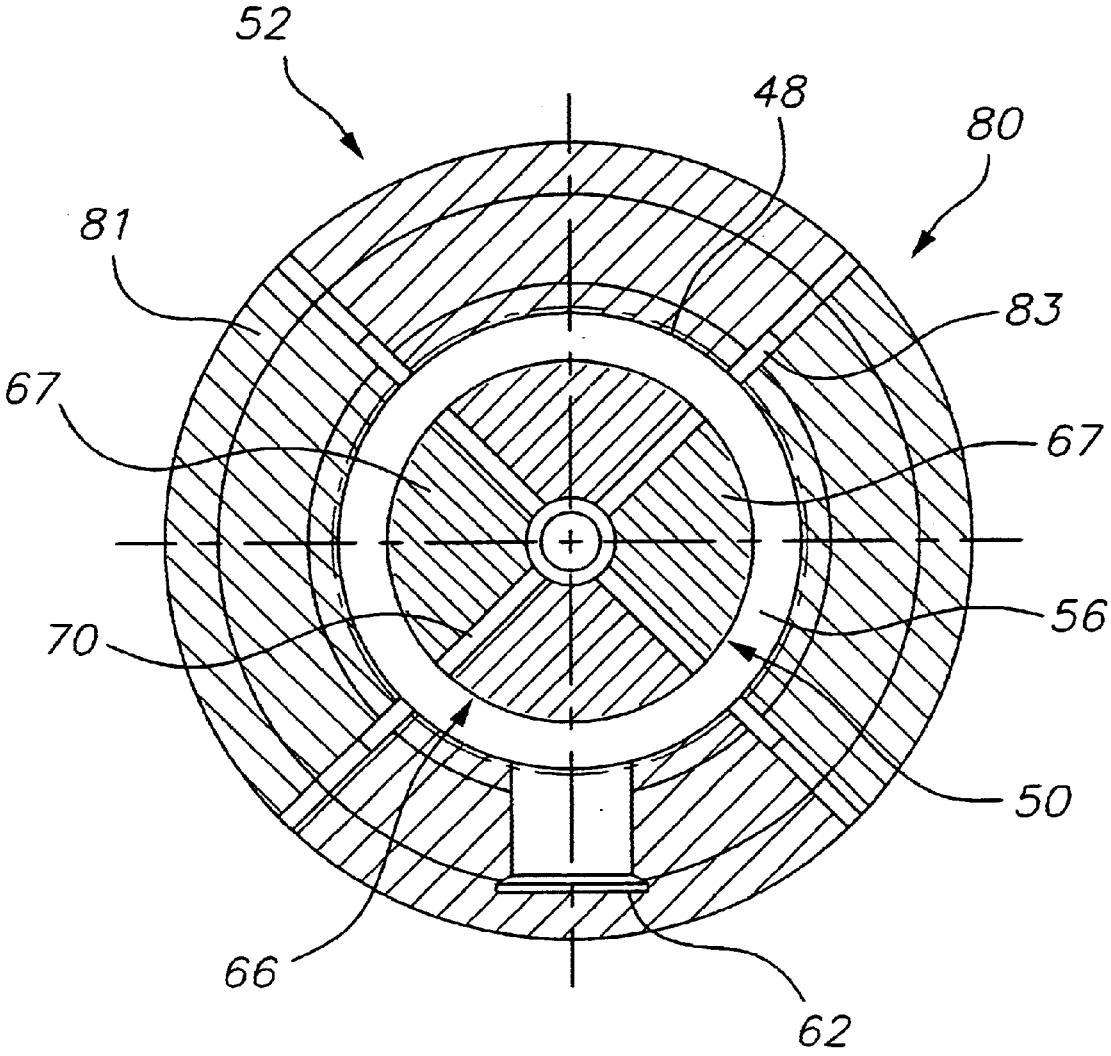
FIG. 4 is a front end view of the heat exchanger of FIG. 3.

The axial magnetic bearing system 50 is coupled to the closed end 56 of the first containment shroud 48 and comprises an axial magnetic bearing stator 66 and an axial magnetic bearing rotor 68. As shown in FIG. 4, the axial bearing stator comprises a plurality of substantially pie-shaped electromagnetic members 67, for example, eight solenoids preferably made from copper, or any other suitable electromagnetic material. The electromagnetic members 67 are preferably radially disposed about central axis in pairs. The electromagnetic members are coupled to the outside of the closed end 56 of the first containment shroud 48 by any suitable structure, for example, a thin stainless steel housing disposed about the outer perimeter of the axial bearing stator 66. A plurality of end supports 70 radially disposed about the central axis separate the pairs of electromagnetic members 67 into four quadrants. The end supports are rib-like members extending outwardly from the closed end 56 of the first containment shroud to provide additional structural strength to the first containment shroud 48. Other configurations and numbers of solenoids could be used in accordance with the present invention.

Each electromagnetic member 67, or solenoid, is independently powered by an amplifier (not shown) to generate an electromagnetic field (EMF) for attracting or lifting the rotary shaft 36. The electromagnetic members are powered or activated and deactivated based on the axial alignment of the rotary shaft 36 at the bearing end 38, as described in detail below.

Referring back to FIG. 3, the axial magnetic bearing rotor 68 is a generally radial disc integrally coupled to the bearing end 38 of the rotary shaft 36 inside the first containment shroud 48. The axial bearing rotor comprises a generally annular axial magnetic core 72 encased within a stainless steel sheathing 74. The magnetic core 72 generally comprises a permanent magnet made from ferrite, a rare earth material, such as samarium-cobalt, neodymium-iron-boron, or aluminum-nickel-cobalt-iron, or any other suitable magnitizable material. The axial bearing rotor 68 is sized and positioned proximate the closed end 56 as needed to generate a magnetic coupling sufficient to handle the expected axial loads of the rotary shaft 36 while, at the same time, maintaining a certain gap between the sheathing 74 and the closed end 56 to prevent any direct friction with the first containment shroud 48. The gap should also allow free flow of any particulate material around the axial magnetic core 72.

A substantially disc-shaped first position sensor 76 is attached to the outer surface of the closed end 56 and symmetrically disposed about the central axis 34. The sensor is preferably a proximity sensor that feeds information about the position of the rotary shaft 36 to a controller or programmable logic computer (PLC). The sensor may be calibrated so that when the rotary shaft is properly aligned along the central axis 34, it produces a null voltage. However, when the rotary shaft is moved above a desired position, a positive voltage is produced, and when it is moved below, a negative voltage results, thereby indicating that the position of the rotary shaft should be adjusted. The first position sensor 76 preferably monitors the position of the shaft every thousandth of a second.

A first asymmetric magnet 78 encased within the sheathing 74 of the axial bearing rotor 68 serves as the "target" for the first position sensor 76. The first asymmetric magnet 78 is asymmetrically disposed about the central axis 34 and generally comprises a magnitizable material.

Because the product inlet 62 is located at the opposite drive head end 26, the axial magnetic bearing needs to generate a controlled magnetic pull so that, in conjunction with the radial magnetic bearing, it counteracts the effect of the flow drag exercised upon the rotary shaft 36. The first asymmetric magnet 78 is purposely installed into the sheathing 74 to increase the resolution of the first magnetic sensor 76 when monitoring the alignment of the rotary shaft 36. Alternatively, any metal may be used as the "target" for the position sensor, or an optical detector may be used to monitor the relative position of the rotary shaft 36.

Moving downstream of the axial bearing system, the radial magnetic bearing system 52 is coupled to a central portion of the first containment shroud 48 and comprises a radial magnetic bearing stator 80 and a radial magnetic bearing rotor 82. As shown both in FIGS. 4 and 5, the radial bearing stator 80 comprises a plurality of partially annular electromagnetic elements 81, for example, eight solenoids preferably made from copper, or any other suitable electromagnetic material. The electromagnetic elements 81 are preferably circumferentially disposed about the outer surface of the first containment shroud sidewall 58 in pairs. The electromagnetic elements are coupled to the first containment shroud sidewall 58 by any suitable structure, for example, a thin stainless steel housing disposed about the outer perimeter of the radial bearing stator 80.

A plurality of longitudinal supports 83 radially disposed about the central axis separate the pairs of electromagnetic elements 81 into four quadrants. The longitudinal supports are rib-like members extending outwardly from and longitudinally along a portion of the outer surface of the first containment shroud sidewall 58. In addition to arranging the electromagnetic elements about the first containment shroud sidewall, the longitudinal supports 83 enhance the structural strength of the first containment shroud.

Each electromagnetic member 81, or solenoid, is independently powered by an amplifier (not shown) to generate an electromagnetic field (EMF) for attracting or lifting the rotary shaft 36. The electromagnetic elements are powered or activated and deactivated based on the axial alignment of the rotary shaft 36 at the bearing end 38, as described in detail below.

The radial magnetic bearing rotor 82 is a generally cylindrical member detachably coupled to the bearing end 38 of the rotary shaft 36. The radial bearing rotor 82 comprises a generally annular radial magnetic core 84 encased within a stainless steel rotor casing 86. The magnetic core 84 generally comprises a permanent magnet made from ferrite, a rare earth metal, or any other suitable magnetizable material. The outer diameter of the casing should be machined to dimensions suitable for the cylindrical magnetic core 84 to reach as close as possible to the sidewall 58 of the first containment shroud 48. This generates the strongest magnetic coupling between the radial bearing stator 80 and rotor 82 while, at the same time, maintaining a certain gap between the outer circumference of the casing 86 and the sidewall 58 to prevent any direct friction with the containment shroud. The gap should allow free flow of any particulate material around the radial magnetic core 84. The casing may be hollowed 85 to "lightweight" the rotary shaft 36. However, the shaft should be symmetrically hollowed to dimensions suitable for maintaining the "radial balance" of the rotary shaft 36.

Figure 5:
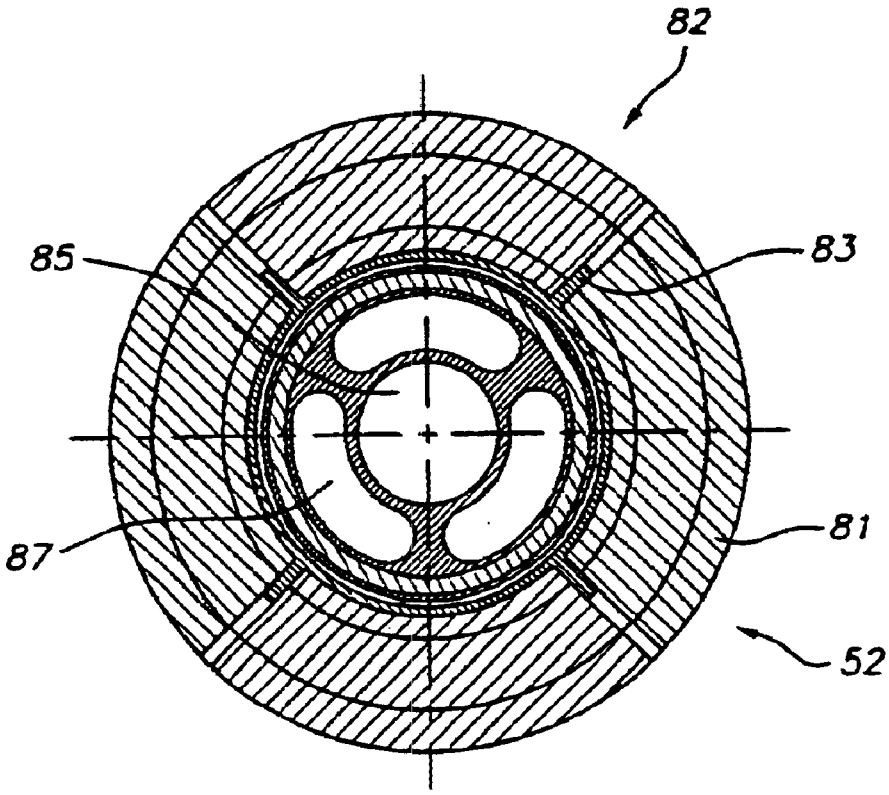
FIG. 5 is an end cross-sectional view of the opposite drive end head of the heat exchanger of FIG. 3 along Section line A—A.

Referring now to FIG. 5, the radial bearing rotor 82 comprises, for example, three flow A passages 87 extending through the casing 86. The passages are radially arranged equi-distantly about the central axis 34, concentric with the radial magnetic core 84. The flow passages 87 are designed to reduce the "flow drag" of the radial bearing rotor 82 and allow food product to pass from the inlet port 62 to the open end 54 of the first containment shroud 48.

Referring back to FIG. 3, the first bearing support member 30, coupled between the containment shroud 48 of the opposite drive head end 26 and the heat transfer tube 22, is a generally annular member comprising a first axial end 88, a second axial end 90, an outer diametrical surface 91, and an inner diameter defining a central bore 92 extending therethrough. The first bearing support member is preferably formed from stainless steel, plastic, ceramic, or any other suitable corrosion resistant material. The first bearing support member includes an annular groove 94 machined about the outer surface 91 at the first axial end 88. The grove is dimensioned to receive the first V-shaped locking member 64 coupled to the open end 54 of the first containment shroud 48. A second substantially V-shaped locking member 96 is coupled to the outer surface 91 at the second axial end 90. The second locking member 96 is constructed to engage an annular groove machined along an inlet end of the heat transfer tube.

The V-shaped locking members 64 and 96 provide for quick disassembly of the first bearing support member 30, between the first containment shroud 48 and the heat transfer tube 22. This provides easy access and assembly of the different mechanical parts installed within the heat exchanger.

The central bore 92 is suitably dimensioned to receive bearing end 38 of the of the rotary shaft 36 and includes an annular notch 98 symmetrically disposed about the central axis 34. The notch 98 is dimensioned to receive a first slide bearing 99 disposed about the first reduced portion 39. The first slide bearing is preferably a linear bearing sized for a 150 lb. shaft at approximately 7.5 horsepower (hp). However, the first slide bearing may comprise any linear bearing suitable for absorbing the axial loads applied by the rotary shaft 36 during operation. The slide bearing provides secondary support to the rotary shaft 36 when the magnetic bearings of the drive head end 24 and the opposite drive head end 26 are deactivated. The rotary shaft 36 is free to rotate about the central axis 34 while the first support bearing is maintained substantially stationary.

Figure 6:
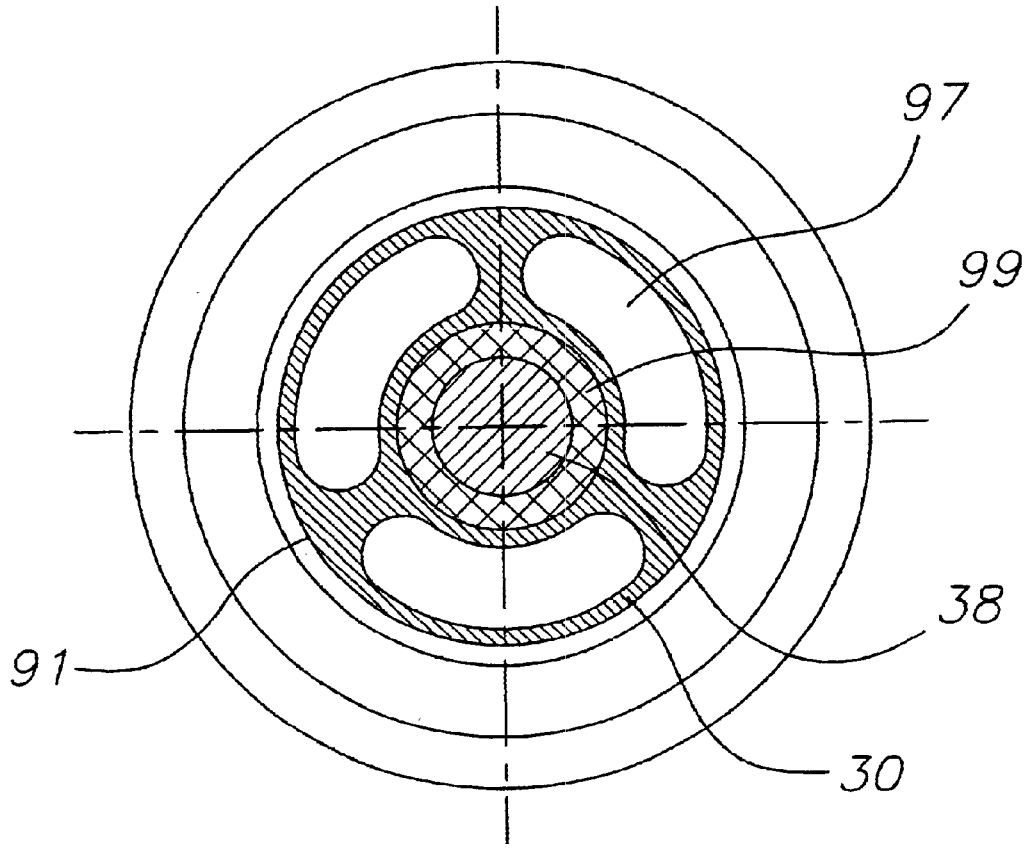
FIG. 6 is an end cross-sectional view of the first bearing support member of the heat exchanger of FIG. 3 along Section line B—B.

Referring to FIG. 6, the first bearing support member 30 includes, for example three, flow openings 97 extending therethrough. The openings are radially arranged equidistantly about the central bore 92 for passing food product from the opposite drive head end 26 to the heat transfer tube 22.

Figure 7:
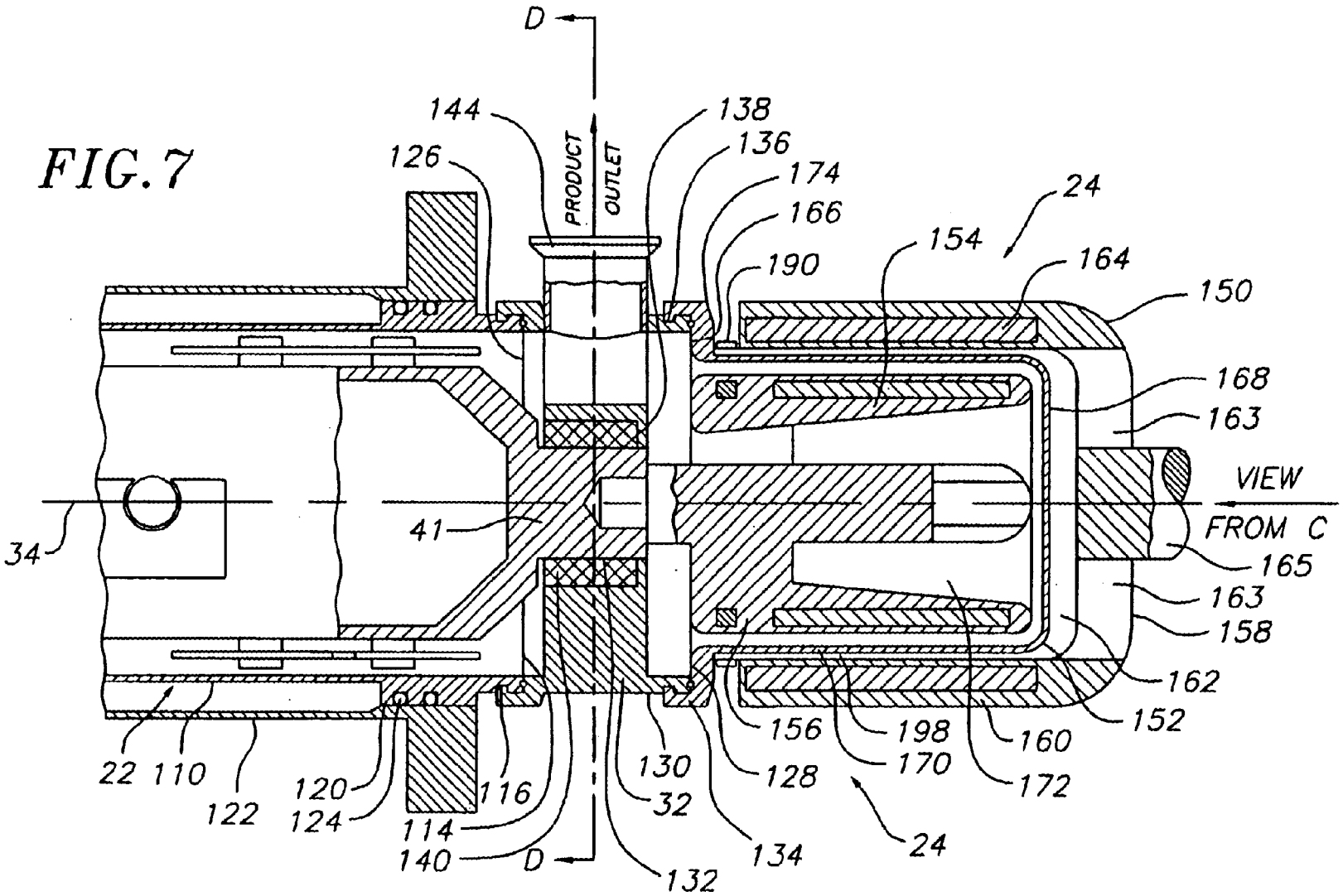
FIG. 7 is a side cross-sectional view of the drive end head of the heat exchanger of FIG. 2.

Now moving to the central region of the heat exchanger, the heat transfer tube 22, as shown in FIGS. 3 and 7, is a generally elongated cylinder comprising a cylindrical heat transfer tube sidewall 110 axially extending between an inlet end 112 and an outlet end 114. The heat transfer tube is preferably made from stainless steel or any other suitable corrosion resistant material. The heat transfer tube sidewall is symmetrically disposed about the central axis 34 and defines a conduit 111 for receiving the central body 42 of the rotary shaft 36. The conduit is also designed to pass food product from the opposite drive head end 26 to the drive head end 24 and an outlet coupled to the second bearing support member 32. The inner surface of the heat transfer tube sidewall 110 is prone to fouling deposit build-up generated by over-processed food product passing through the heat transfer tube. The inner surface is generally "cleaned" by the scraper blades 44 coupled to the rotary shaft 36.

A second bearing support member 32 couples the drive head end 24 to the outlet end 114 of the heat transfer tube 22. Annular slots 116 are machined about the outer surface of the heat transfer tube sidewall 110 at both the inlet and outlet ends 112 and 114. The slots are dimensioned to receive substantially V-shaped locking members coupled to the first and second bearing support members 30 and 32.

The heat transfer tube 22 carries annular flanges that extend outwardly from the sidewall 110 about the inlet and outlet ends 112 and 114. A media jacket 122 is concentrically mounted about the heat transfer tube along the annular flanges 118 and 120. The media jacket is a substantially cylindrical drum used to carry heating or cooling media. A pair of O-rings 124 are disposed within o-ring grooves etched along the annular flanges 118 and 120 to seal the coupling between the media jacket 122 and the heat transfer tube 22.

Referring now to FIG. 7, the second bearing support member 32, coupled between the heat transfer tube 22 and the drive head end 24, is a generally annular member comprising a first axial end 126, a second axial end 128, an outer diametrical surface 130, and an inner diameter defining an aperture 132 extending therethrough. The second bearing support member is preferably formed from stainless steel or any other suitable corrosion resistant material. A third substantially V-shaped locking member 134 is coupled to the outer surface 130 at the first axial end 90. The locking member 134 is constructed to engage the annular slot 116 disposed about the outlet end 114 of the heat transfer tube 22. An annular groove 136 is channeled about the outer surface 130 of the second bearing support member at the second axial end 128. The groove is dimensioned to receive a substantially V-shaped locking member coupled to a containment shroud at the drive head end 24.

The V-shaped locking members provide for quick disassembly of the second bearing support member 32, between the drive head end 24 and the heat transfer tube 22. This again provides easy access and assembly of the various mechanical parts installed within the heat exchanger 20.

The aperture 132 is suitably dimensioned to receive the drive end 40 of the of the rotary shaft 36 and includes an annular notch 138 symmetrically disposed about the central axis 34. The notch is dimensioned to receive a second slide bearing 140 disposed about the second reduced portion 41. The second slide bearing is preferably identical in construction to the first slide bearing 99 of the first bearing support member 30. The slide bearing provides secondary support to the rotary shaft 36 when the magnetic bearings of the drive head end 24 and the opposite drive head end 26 are deactivated. The rotary shaft 36 is free to rotate about the central axis 34 while the second support bearing is maintained substantially stationary.

Figure 8:
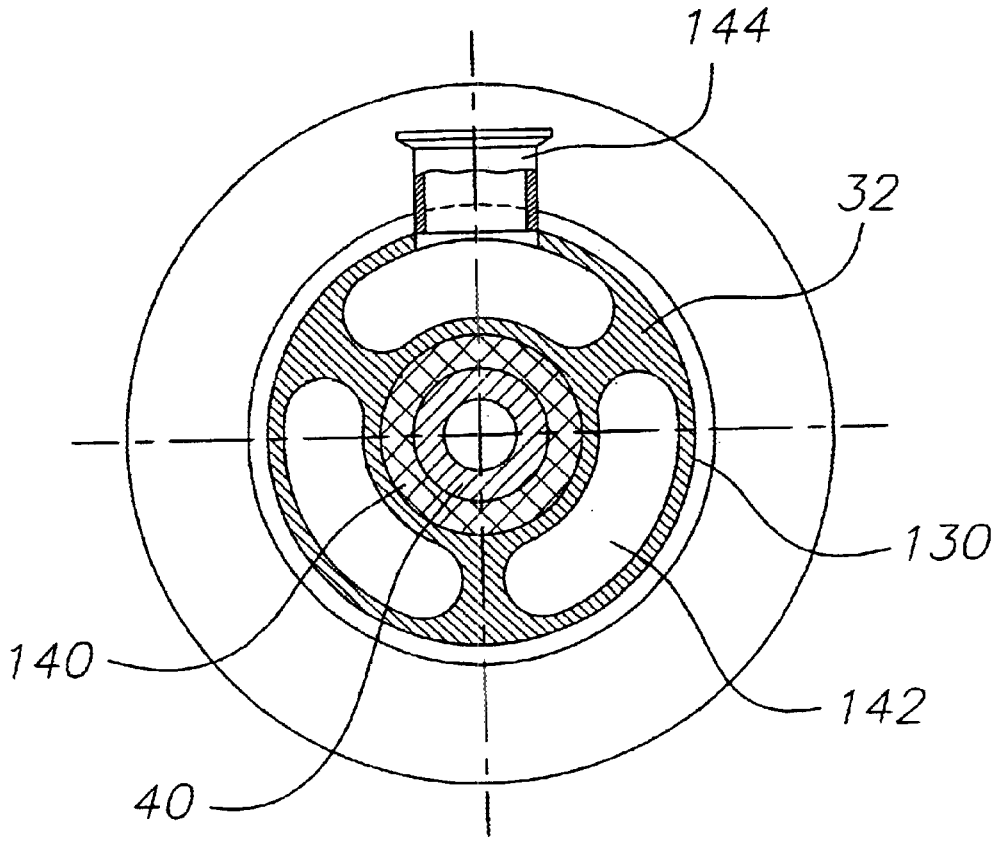
FIG. 8 is an end cross-sectional view of the second bearing support member of the heat exchanger of FIG. 7 along Section line D—D.

Referring to FIG. 8, the second bearing support member 32 includes, for example, three flow channels 142 extending therethrough. The channels are radially arranged equidistantly about the aperture for passing food product from the heat transfer tube 22 to drive head end 24. An outlet port 144 is coupled to a central portion of the second bearing support member 32. The outlet port communicates with at least one of the flow channels to expel a main portion of the food product passing through the heat exchanger 20. The portion of food product that is not expelled by the outlet port 144 is passed to the drive head end 24, where it is re-circulated until it is expelled from the heat exchanger through the outlet port 144, as discussed further below.

Referring back to FIG. 7, the drive head end 24 includes an outer magnet assembly 150, a second containment shroud 152, and an inner magnet assembly 154. As shown in FIG. 8, the outer magnet assembly 150 comprises a generally cylindrical casing having an open axial end 156, an enclosed end 158, and a cylindrical wall 160 axially extending between the open and enclosed axial ends. The cylindrical wall 160 is symmetrically disposed about the central axis 34. The cylindrical wall 160 and the enclosed end 158 define a cell 162 that encloses the interior components of the drive head end 24. The cylindrical wall 160 comprises a generally annular outer magnet ring 164 comprising a permanent magnet made from ferrite, a rare earth metal, or any other suitable magnetizable material. The magnetic ring 164 is magnetically coupled to the inner magnet assembly 154 to serve as the main support means for the rotary shaft 36 at the drive end 40.

The portion of the enclosed end 158 may be hollowed-out 163 (shown by the break in cross-section at the enclosed end) to provide visual inspection of the second containment shroud's 152 concentric alignment with the outer magnet assembly 150. An axial end of a drive shaft 165 is coupled to the outer magnet assembly 150 at the enclosed axial end 158. The drive shaft is coupled to a gear or drive box, which serves at the heat exchanger's principal rotary drive.

Figure 9:
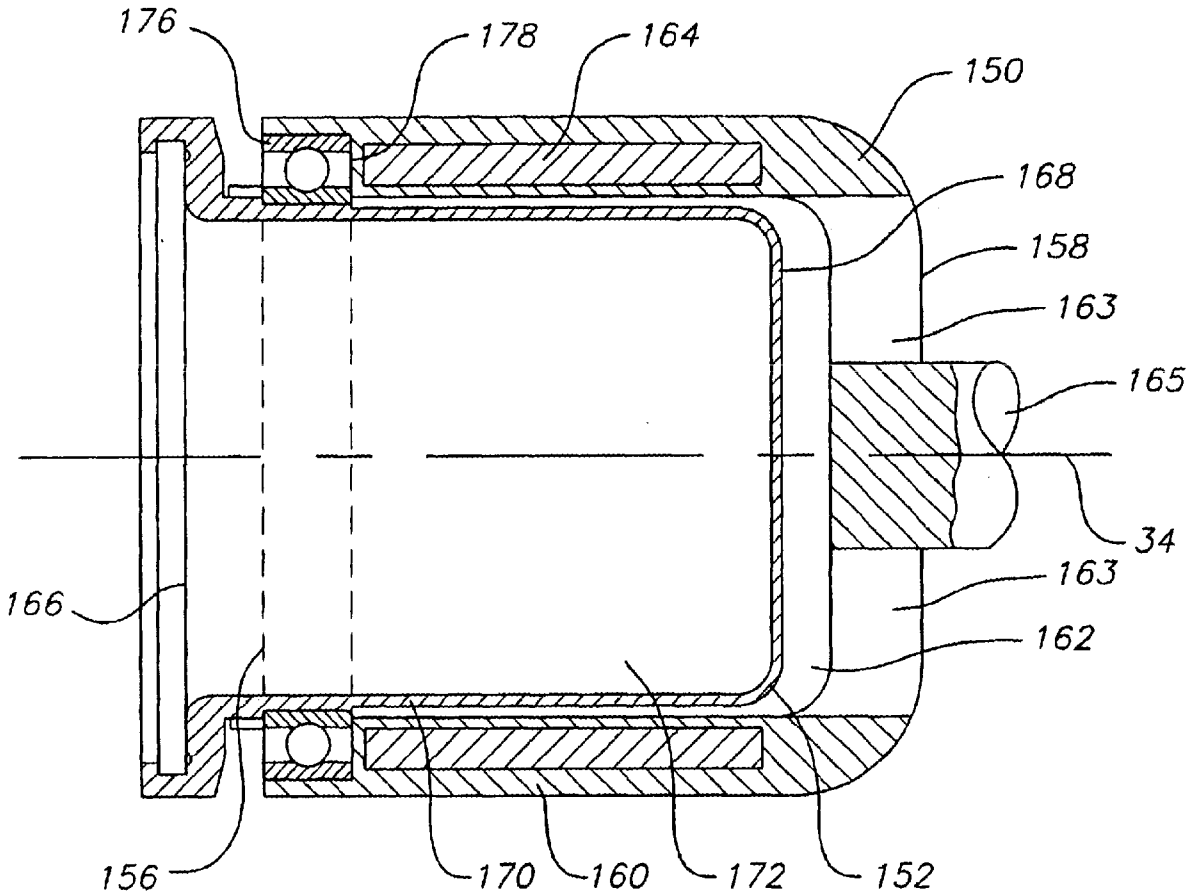
FIG. 9 is a side cross-sectional view of the outer magnet assembly and second containment shroud of the heat exchanger of FIG. 7.

As shown in FIGS. 7 and 9, the second containment shroud 152 is disposed within the cell 162 of the outer magnet assembly 150. The second containment shroud is a generally cylindrical structure comprising an open shroud end 166, a closed shroud end 168, and a second containment shroud sidewall 170 axially extending between the open and closed ends. The containment shroud may be made from stainless steel or any other suitable corrosion resistant material. The second containment shroud sidewall 170 is symmetrically disposed about the heat exchanger's central axis 34. The second containment shroud sidewall and closed shroud end define a well 172 for receiving the inner magnet assembly 154.

A fourth substantially V-shaped locking member 174 is integrally formed about the open end 166 of the second containment shroud 152. The locking member is configured to engage the annular groove 136 channeled about the second axial end 128 of the second bearing support member 32.

As best shown in FIG. 9, the second containment shroud 152 is coupled to the outer magnet assembly 150 by a ball bearing 176 "press fit" about an outer surface of the second containment shroud's annular sidewall 170 at the open end 166. The ball bearing engages a seat 178 formed about an inner surface of the cylindrical wall along the open shroud end 156. The seat is preferably machined to dimensions corresponding to the outer diameter of the ball bearing, such that the ball bearing is "press fit" into the seat 178.

In accordance with the present embodiment, the ball bearing 176 rotatably couples the outer magnet assembly 150 to the second containment shroud 152. As such, the outer magnet assembly 150 is free to rotate about the second containment shroud 152, while the second containment shroud is maintained substantially stationary.

Figure 10:
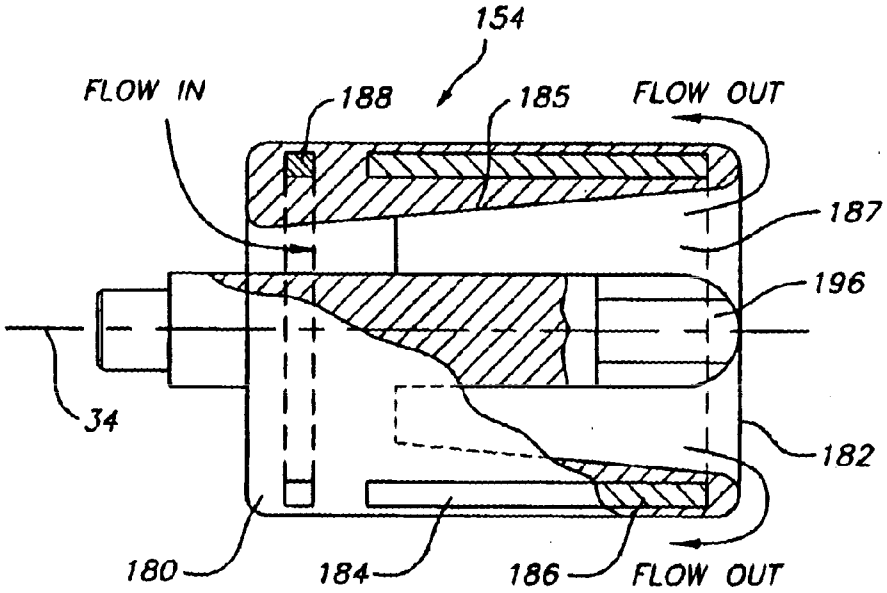
FIG. 10 is a partial cut-away side view of the inner magnet assembly of the heat exchanger of FIG. 7.

Referring back to FIG. 7, the inner magnet assembly 154 is coupled to the drive end 40 of the rotary shaft 36. As shown in FIG. 10, the inner magnet assembly is a generally cylindrical structure comprising a plate or base 180 at one axial end, an outlet 182 at an opposite axial end, and an angled sidewall 184 axially extending between the inlet and the outlet. The inner magnet is preferably formed from stainless steel or any other suitable corrosion resistant material. The angled sidewall 184 is symmetrically disposed about the central axis 34 and comprises an angled inner surface 185. The angled inner surface 185 defines a substantially conical opening 187 for expanding the flow path of food product passing from the base 180 to the outlet 182.

A generally annular inner magnet ring 186 is encased within sidewall 184. The inner magnet ring 186 preferably comprises a permanent magnet made from ferrite, a rare earth metal, or any other suitable magnetizable material.

The sidewall 184 also comprises a second asymmetric magnet 188 encased within the angled sidewall 184 along the base 180. The second asymmetric magnet is preferably made from a magnetizable material. As shown in FIG. 7, the second asymmetric magnet 188 cooperates with a second magnetic sensor 190 coupled to the outer surface of the second containment shroud sidewall 170 about the open end 166. The second asymmetric magnet 188 and the second magnetic sensor 190 cooperate to monitor the state of rotation, for example, the actual revolutions per minute (RPM) of the rotary shaft 36. The second asymmetric magnet and sensor also cooperate to monitor the amount of torque transferred, or the relative slip, between the outer magnetic ring 164 and the and the inner magnetic ring 186. Alternatively, the gap between the outer magnet assembly 150 and the second containment shroud 152, as well as the state of rotation and torque transfer, may be monitored by an optical device. Preferably, the PLC processes the information read by the sensor to control the speed and power of the main drive.

Figure 11:
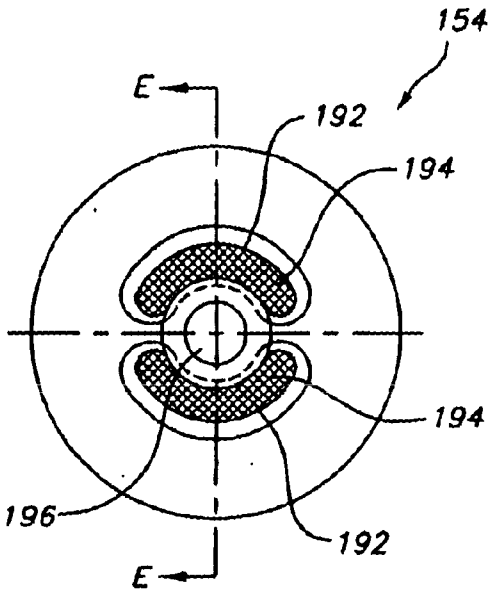
FIG. 11 is an end top view of the inner magnet assembly of FIG. 10.

Referring now to FIG. 11, the base 180 of the inner magnet assembly comprises a pair of diametrically opposed substantially C-shaped openings 192 symmetrically disposed about the central axis. Each opening 192 carries a perforated plate 194. The perforated plates "conditions" or "cleans" the food product passing through the perforations. A generally cylindrical hub 196 (shown in FIG. 10) symmetrically disposed about the central axis 34 axially extends from the base 180 into the conical opening 187.

In accordance with the present invention, as depicted in FIG. 10, the inner magnet assembly 154 resembles an "inverted cup." Because the inner magnet assembly 154 is a rotating mechanism, the angled inner surface 185 of the sidewall 184 cooperates with the substantially axial outer surface of the hub 196 to change the radius fluid flow passing through the conical opening 187. The change in radius along the axis of the "inverted cup" generates a kinetic-energy increase effect, similar to that in centrifugal pumps. As a result, the food product entering the drive head end 24 through the openings 192 will continually be re-circulated through the conical opening 187 and back through an annular passageway 198 (shown in FIG. 7) between an outer surface of the inner magnet assembly sidewall 184 and an inner surface of the second containment shroud sidewall 170. The perforated plates 194 prevent particles or burn-on flakes from entering the re-circulation stream. The perforated plates are kept "clean" by the main flow of the fluid or food product passing through the outlet port 144.

With reference to FIGS. 3 and 7, during operation, the heat exchanger's main gear box drives the drive shaft 165 coupled to the outer magnet assembly 150. The magnetic coupling between the outer magnet assembly 150 and the inner magnet assembly 154 transfers the mechanical torque from the outer magnet assembly 150 to the inner magnet assembly 154 to rotate the rotary shaft 36. The magnet coupling between the outer magnet assembly 150 and the inner magnet assembly 154 at the drive head end 24 not only functions to transfer torque from the drive shaft 165 to the rotary shaft 36, but also permanently "suspends" the rotary shaft 36 about the central axis 34, serving as a main bearing support for the drive end 40 of the rotary shaft.

At the opposite drive head end 26, the radial bearing system 52 "suspends" the rotary shaft 36, serving as a main bearing support for the rotary shaft at the bearing end 38. The axial bearing system 50 adjusts the position of the rotary shaft axially along the central axis 34. Together, the radial bearing system 52 and the axial bearing system 50 cooperate to control the axial alignment of the rotary shaft 36.

Food product continually passing into the heat exchanger 20 at the inlet port 62 exert certain hydraulic forces on the rotary shaft that influences its axial alignment at the bearing end 38. Because efficient operation of the heat exchanger depends on the radial and axial stiffness of the rotary shaft 36, the axial and bearing systems 50 and 52 are dynamic systems. Specifically, the first position sensor 76 monitors the position of the rotary shaft at the bearing end, preferably, every thousandth of a second. If the sensor detects that the rotary shaft is misaligned, a signal will be sent to the PLC, which in turn communicates with the amplifier providing power to the axial and radial bearing stators 66 and 80. The amplifiers in turn power a quadrant of the axial and radial bearing stators to "correct" the rotary shaft misalignment. The first and second bearing supports 30 and 32 act as secondary bearing supports to support the rotary shaft when the magnetic bearings of the opposite drive head end 26 are not powered.

The food product is then passed through the flow passages of the radial bearing rotor and the flow opening of the first bearing support member, into the heat transfer tube. As food product passes through the heat transfer tube 22, it is either heated or cooled by the media jacket, and the scraper blades 44 carried by the rotary shaft 36 remove any particulate from the inner surface of the heat transfer tube sidewall 110. Food product passing from the outlet end of the heat transfer tube is passed through the flow channels of the second bearing support to the outlet port, or re-circulated in the drive head end.

Figure 12:
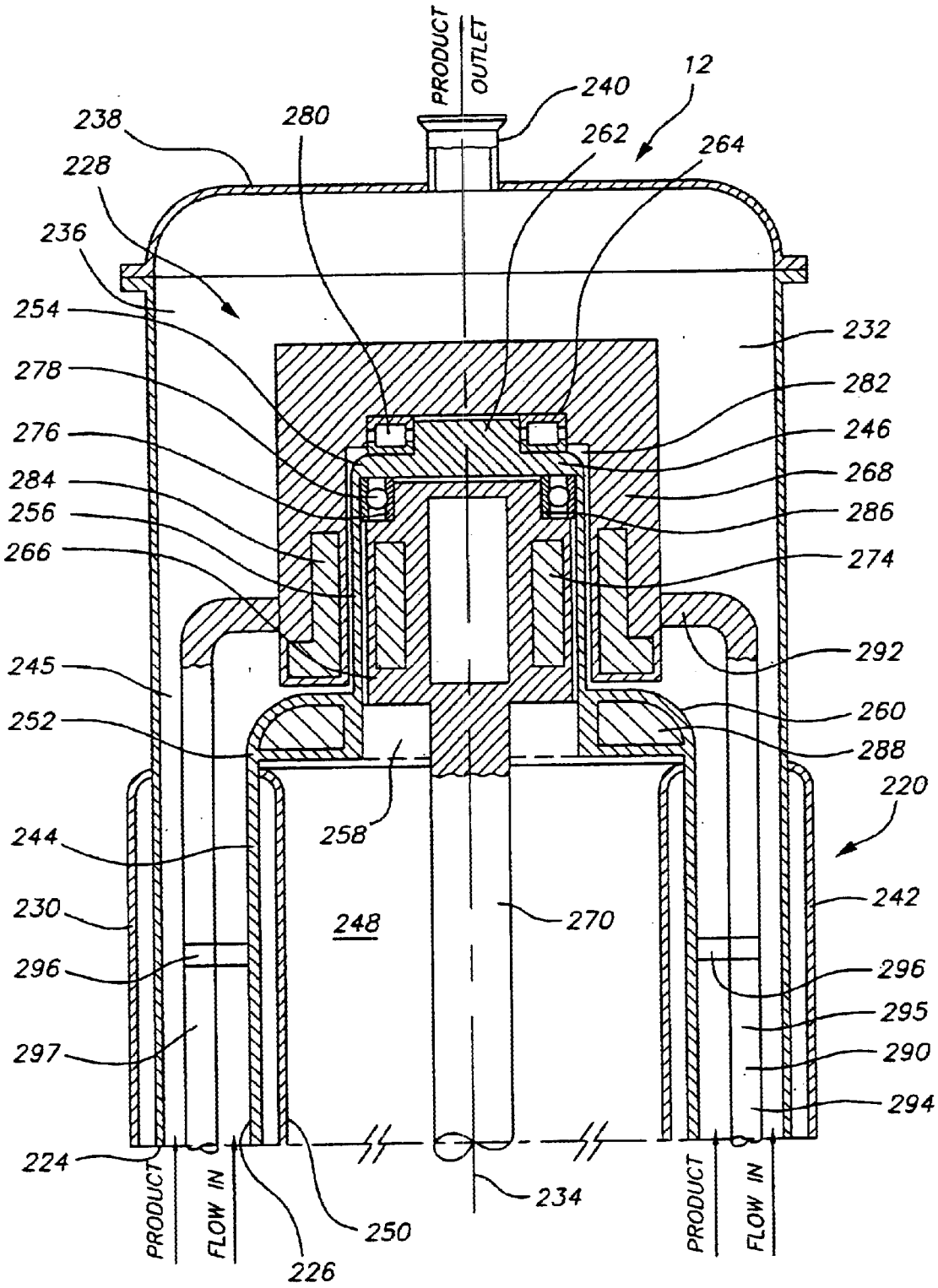
FIG. 12 is a cross-sectional side view of a second embodiment heat exchanger in accordance with the invention.

FIG. 12 illustrates an alternative embodiment of a heat exchanger 220 in accordance with the invention. The heat exchanger 220 is a vertically arranged structure having a drive end head 222 disposed at the upper most region of the structure. The lower region of the heat exchanger (not shown) generally comprises a closed bottom with an inlet port for introducing a fluid product into the heat exchanger.

The drive end head 222 comprises an outer heat transfer tube 224, an inner heat transfer tube 226, and a magnetic bearing system 228. The outer heat transfer tube 224 is a generally cylindrical tube comprising a substantially upstanding cylindrical sidewall 230 and an open top 232. The outer heat transfer tube is made from any suitable corrosion resistant material. The cylindrical sidewall 230 is symmetrically disposed about a central axis 234. The sidewall 230 defines a chamber 236 that houses the inner heat transfer tube 226 and the magnetic bearing system 228. A substantially spherical end cap 238 is coupled to the open top 232 to enclose the chamber 236. The end cap 238 carries an outlet port 240 symmetrically disposed about the central axis 234. The outlet port 240 communicates with the chamber 236 to expel food product passing through the heat exchanger 220. An outer media jacket 242 is concentrically disposed about the outer surface of the upstanding sidewall 230 for the passage of the heat exchange media.

The inner heat transfer tube 226 is a generally elongated cylindrical tube coaxially and concentrically disposed within the outer heat transfer tube 224. The inner heat transfer tube 226 includes a substantially vertical cylindrical sidewall 244 and a bearing shroud 246 coupled to its upper most axial end. The cylindrical sidewall 244 is symmetrically disposed about the central axis 234 and defines a duct 248 for receiving a drive shaft extending therethrough. The vertical sidewall 244 is concentrically arranged with the upstanding sidewall 230 of the outer heat transfer tube. The vertical and upstanding sidewalls 244 and 230 define an annular passage 245 for passing food product from an inlet located in the lower region of the heat exchanger to the outlet port 240. An inner media jacket 250 is concentrically disposed within an inner surface of the vertical sidewall 244.

The bearing shroud 246 is a generally cylindrical structure that defines a chamber that communicates with the duct 248 at a first axial end 252, and is closed at a second axial end 254. The shroud includes a generally cylindrical wall 256 vertically extending from the first axial end 252 to the closed second axial end 254. The wall is symmetrically disposed about the central axis 234, defining a recess 258 for receiving a rotor coupled to the main drive shaft.

The bearing shroud 246 also comprises an annular flange 260 formed about the first axial end 252. The annular flange is coupled to the upper most axial end of the inner heat transfer tube 226, partially enclosing the duct 248 in the drive end head 222. A stubshaft 262 upwardly extending from the closed second axial end 254 is symmetrically disposed about the central axis 234. The stubshaft 262 and the second axial end 254 cooperatively define a rotor seat 264 for receiving a thrust bearing coupled to a rotating boss supporting a rotating scraper frame.

The magnetic bearing system 228 of the present embodiment comprises a rotor 266 and a rotating boss 268. The rotor 266 is a cylindrical body comprising stainless steel or any other suitable corrosion resistant material. The rotor 266 is preferably machined to a tolerance suitable for the outer diameter of the rotor reach as close as possible to the cylindrical wall 256 of the bearing shroud 246. This provides the strongest magnetic coupling between the rotor 266 and the rotating boss 268, while maintaining a certain gap between the rotor 266 and the cylindrical wall 256 to prevent any direct friction with the bearing shroud 246. The gap should also allow free flow of any particulate material around the axial magnetic core 72.

The rotor 266 is coupled to an axial end of a main drive shaft 270 longitudinally extending along the central axis 234 to a gear or "drive" box (not shown) located within a lower region of the heat exchanger 220. The rotor may be hollowed to "lightweight" or reduce the inertial mass of the rotor. The main drive shaft 270 extends down through the duct 248 and is connected to a gear or "drive" box (not shown) located within a lower region of the heat exchanger 220.

The main drive shaft 270 turns the rotor 266, which turns the rotating boss 268 through a magnetic coupling. Specifically, a substantially cylindrical inner magnet ring 274 is contained within the rotor 266 and symmetrically disposed about the central axis 234. The inner ring 274 preferably comprises ferrite, rare earth metals, or any other suitable magnetizable material. A step 276 formed about rotor's upper perimeter receives a radial bearing 278 that rotatably couples the rotor 266 to the cylindrical wall 256 of the bearing shroud 246.

A thrust bearing 280 "press fit" into the rotor seat 264 rotatably couples the bearing shroud 246 of the inner heat transfer tube 226 to the rotating boss 268. The rotating boss 268 is a generally cylindrical body symmetrically disposed about the central axis 234. The rotating boss includes a generally cylindrical pocket 282 suitably dimensioned to receive the bearing shroud 246. The rotating boss 268 encloses an outer magnet ring 284 symmetrically disposed about the central axis 234. The outer magnet ring is generally annular and has a substantially L-shaped cross-section. The outer magnet ring is preferably made from the same material as the inner magnet ring 274. The outer magnet ring is polarized to magnetically attract the inner magnet ring. The bi-polar attraction magnetically couples the inner and outer magnet rings to transfer mechanical torque from the rotor 266 to the rotating boss 268.

A generally radial detent 286 is formed atop the cylindrical pocket 282. The detent 286 receives the radial bearing 278 and is suitably dimensioned to prove the radial bearing with a "press fit." The radial bearing 278 rotatably couples the rotating boss 268 to the bearing shroud 246 of the inner heat transfer tube 226.

The annular flange 260 of the bearing shroud 246 encloses a support magnet ring 288 symmetrically disposed about the central axis 234. The support magnet ring is generally annular and preferably made from the same material as the outer magnet ring 284. The support magnet ring is polarized to magnetically repel the outer magnet ring. The magnetic repulsion of the outer and support magnet rings "suspends" the rotating boss 268 above the bearing shroud's annular flange 260 to ease the weight load of the rotating boss applied to the thrust bearing 280.

A plurality scraper support members 290 are disposed about rotating boss's 268 outer periphery. The scraper support members are substantially L-shaped members having a fixed end 292 attached to the body of the rotating boss, and a suspended end 294 extending longitudinally into the annular passage 245. The scraper support members are constructed in two sets. A first set, depicted as numeral 295, carries a series of scraper blades 296 inwardly extending from the support member towards the inner heat transfer tube 226. A second set, depicted as numeral 297, carries a series of scraper blades 296 outwardly extending from the support member towards the inner heat transfer tube 226. The scraper blades of the first set of scraper support members are configured to engage and remove fouling deposit accumulated along the outer surface of the inner heat transfer tube 226. The scraper blades of the second set of scraper support members are configured to engage and remove fouling deposit accumulated along the inner surface of the outer heat transfer tube 224. The first and second sets of scraper support members are preferably alternately disposed about the boss to form a "frame" for cleaning the inner and outer surfaces of the outer and inner heat transfer tube sidewalls, respectively.

In accordance with the various embodiments described herein, the present invention provides scraped-surface heat exchangers that advantageously transfer mechanical torque using magnetic coupling. The heat exchangers also take advantage of magnetic bearings for suspending and aligning the rotary shaft.

The embodiments of the present invention describe the use of substantially V-shaped locking members for coupling various components of the heat exchangers. However, those skilled in the art will appreciate that these components may be coupled together by bolted flanges or other suitable coupling means.

The preceding description has been presented with reference to certain embodiments of the invention. While embodiments of the present invention are described for use with scraped-surface heat exchangers, workers skilled in the art and technology to which this invention pertains will appreciate that the present invention may be used for various devices currently utilizing rotary mechanical seals, and alterations and changes in the described device may be practiced without meaningfully departing from the principal, spirit and scope of the invention. Accordingly, the foregoing and accompanying drawings should not be read as pertaining only to the precise embodiments described, but rather should be read consistent and as support to the following claims which are to have their fullest and fair scope.

What is claimed is:

1. A scraped-surface heat exchanger comprising:

an elongated generally cylindrical heat transfer tube having an inlet, an outlet, and a sidewall defining a chamber between the inlet and the outlet;

an elongated media tube in surrounding relation to the heat transfer tube;

a rotary shaft mounted axially within the heat transfer tube, the rotary shaft having an outer surface and one or more scraper blades extending from the outer surface of the rotary shaft;

a drive head end containment shroud mounted at an axial end of the heat transfer tube, the drive head end containment shroud having a closed end, an open end, and a sidewall defining a drive head chamber in open communication with the interior chamber of the heat transfer tube through the open end of the containment shroud;

an inner rotatable magnet assembly mounted within the drive head chamber of the drive head end containment shroud and connected to the rotary shaft, wherein the inner rotatable magnet assembly comprises a generally cylindrical sidewall defining a chamber and having an outer surface spaced apart from the sidewall of the drive head end containment shroud; and an outer rotatable magnet assembly mounted outside the drive head end containment shroud and magnetically coupled to the inner rotatable magnet assembly; wherein, in use, rotation of the outer magnet assembly results in rotation of the inner magnet assembly, which results in rotation of the rotary shaft.

2. A scraped-surface heat exchanger according to claim 1, wherein the drive head end containment shroud is mounted on the end of the heat transfer tube proximate the outlet.

3. A scraped-surface heat exchanger according to claim 1, wherein the outer rotatable magnet assembly is generally cylindrical and mounted around the circumference of the sidewall of the drive head end containment shroud.

4. A scraped-surface heat exchanger according to claim 1, wherein the inner rotatable magnet assembly further comprises a generally circular end plate connected to an axial end of the sidewall of the inner magnet assembly proximate the rotary shaft, the generally circular end plate having at least one opening therethrough, and further wherein the opposite axial end of the inner magnet assembly is generally open;

whereby, in use, fluid passes from the chamber of the heat transfer tube, through the at least one opening in the generally circular base, into the chamber of the inner magnet assembly, through the generally open end of the inner magnet assembly and between the outer surface of the inner magnet assembly sidewall and the sidewall of the drive head end containment shroud to return to the interior chamber of the heat transfer tube.

5. A scraped-surface heat exchanger according to claim 1, further comprising a second containment shroud mounted at an axial end of the heat transfer tube opposite the drive head end containment shroud, the second containment shroud having a closed end, an open end, and a sidewall defining a cavity in open communication with the interior chamber of the heat transfer tube through the open end of the second containment shroud.

6. A scraped-surface heat exchanger according to claim 5, further comprising an axial magnetic bearing system comprising:

an axial magnetic rotor coupled to the rotary shaft and contained within the second containment shroud, and an axial magnetic bearing stator mounted outside the second containment shroud;

wherein, in use, the axial magnetic bearing stator generates an electromagnetic field to longitudinally align the axial magnetic rotor and rotary shaft in a desired position relative to the heat transfer tube.

7. A scraped-surface heat exchanger according to claim 6, wherein the axial magnetic rotor comprises a magnetic core encased within a stainless steel sheathing.

8. A scraped-surface heat exchanger according to claim 7, wherein the axial magnetic rotor is generally disc-shaped.

9. A scraped-surface heat exchanger according to claim 6, wherein the axial magnetic bearing stator comprises at least one solenoid mounted to the outside of the closed end of the drive head end containment shroud.

10. A scraped-surface heat exchanger according to claim 6, wherein the axial magnetic bearing stator comprises at least four solenoids mounted to the outside of the closed end of the drive head end containment shroud.

11. A scraped-surface heat exchanger according to claim 5, further comprising a radial magnetic bearing system comprising:

a radial magnetic rotor coupled to the rotary shaft and contained within the second containment shroud, and a radial magnetic bearing stator mounted outside the second containment shroud;

wherein, in use, the radial magnetic bearing stator generates an electromagnetic field to radially align the radial magnetic rotor and rotary shaft in a desired position relative to the heat transfer tube.

12. A scraped-surface heat exchanger according to claim 11, wherein the radial magnetic rotor comprises a generally-cylindrical member having a radial magnetic core encased within a stainless steel casing.

13. A scraped-surface heat exchanger according to claim 11, wherein the radial magnetic bearing stator comprises at least one solenoid.

14. A scraped-surface heat exchanger according to claim 13, wherein the at least one solenoid is circumferentially mounted around the outside of the second containment shroud.

15. A scraped-surface heat exchanger according to claim 11, wherein the radial magnetic bearing stator comprises at least four solenoids.

16. A scraped-surface heat exchanger comprising:

an elongated generally cylindrical heat transfer tube having an inlet, an outlet, and a sidewall defining a chamber between the inlet and the outlet;

an elongated media tube in surrounding relation to the heat transfer tube;

a rotary shaft mounted axially within the heat transfer tube, the rotary shaft having an outer surface and one or more scraper blades extending from the outer surface of the rotary shaft;

a drive head end containment shroud mounted at an axial end of the heat transfer tube, the drive head end containment shroud having a closed end, an open end, and a sidewall defining a drive head chamber in open communication with the interior chamber of the heat transfer tube through the open end of the containment shroud;

an inner rotatable magnet assembly mounted within the drive head chamber of the drive head end containment shroud and connected to the rotary shaft;

an outer rotatable magnet assembly mounted outside the drive head end containment shroud and magnetically coupled to the inner rotatable magnet assembly; and a second containment shroud mounted at an axial end of the heat transfer tube opposite the drive head end containment shroud, the second containment shroud having a closed end, an open end, and a sidewall defining a cavity in open communication with the interior chamber of the heat transfer tube through the open end of the second containment shroud, wherein, in use, rotation of the outer magnet assembly results in rotation of the inner magnet assembly, which results in rotation of the rotary shaft.

17. A scraped-surface heat exchanger according to claim 16, wherein the drive head end containment shroud is mounted on the end of the heat transfer tube proximate the outlet.

18. A scraped-surface heat exchanger according to claim 16, wherein the outer rotatable magnet assembly is generally cylindrical and mounted around the circumference of the sidewall of the drive head end containment shroud.

19. A scraped surface heat exchanger according to claim 16, wherein the inner rotatable magnet assembly comprises a generally cylindrical sidewall defining a chamber and having an outer surface spaced apart from the sidewall of the drive head end containment shroud.

20. A scraped-surface heat exchanger according to claim 19, wherein the inner rotatable magnet assembly further comprises a generally circular end plate connected to an axial end of the sidewall of the inner magnet assembly proximate the rotary shaft, the generally circular end plate having at least one opening therethrough, and further wherein the opposite axial end of the inner magnet assembly is generally open;

whereby, in use, fluid passes from the chamber of the heat transfer tube, through the at least one opening in the generally circular base, into the chamber of the inner magnet assembly, through the generally open end of the inner magnet assembly and between the outer surface of the inner magnet assembly sidewall and the sidewall of the drive head end containment shroud to return to the interior chamber of the heat transfer tube.

21. A scraped-surface heat exchanger according to claim 16, further comprising an axial magnetic bearing system comprising:

an axial magnetic rotor coupled to the rotary shaft and contained within the second containment shroud, and an axial magnetic bearing stator mounted outside the second containment shroud;

wherein, in use, the axial magnetic bearing stator generates an electromagnetic field to longitudinally align the axial magnetic rotor and rotary shaft in a desired position relative to the heat transfer tube.

22. A scraped-surface heat exchanger according to claim 21, wherein the axial magnetic rotor comprises a magnetic core encased within a stainless steel sheathing.

23. A scraped-surface heat exchanger according to claim 22, wherein the axial magnetic rotor is generally disc-shaped.

24. A scraped-surface heat exchanger according to claim 21, wherein the axial magnetic bearing stator comprises at least one solenoid mounted to the outside of the closed end of the drive head end containment shroud.

25. A scraped-surface heat exchanger according to claim 21, wherein the axial magnetic bearing stator comprises at least four solenoids mounted to the outside of the closed end of the drive head end containment shroud.

26. A scraped-surface heat exchanger according to claim 16, further comprising a radial magnetic bearing system comprising:

a radial magnetic rotor coupled to the rotary shaft and contained within the second containment shroud, and a radial magnetic bearing stator mounted outside the second containment shroud;

wherein, in use, the radial magnetic bearing stator generates an electromagnetic field to radially align the radial magnetic rotor and rotary shaft in a desired position relative to the heat transfer tube.

27. A scraped-surface heat exchanger according to claim 26, wherein the radial magnetic rotor comprises a generally-cylindrical member having a radial magnetic core encased within a stainless steel casing.

28. A scraped-surface heat exchanger according to claim 26, wherein the radial magnetic bearing stator comprises at least one solenoid.

29. A scraped-surface heat exchanger according to claim 28, wherein the at least one solenoid is circumferentially mounted around the outside of the second containment shroud.

30. A scraped-surface heat exchanger according to claim 26, wherein the radial magnetic bearing stator comprises at least four solenoids.

* * * * *